US005099459A

United States Patent [19]

Smith

[11] Patent Number: 5,099,459

[45] Date of Patent: Mar. 24, 1992

[54] PHASED ARRAY ULTROSONIC TRANSDUCER INCLUDING DIFFERENT SIZED PHEZOELECTRIC SEGMENTS

[75] Inventor: Lowell S. Smith, Schenactady, N.Y.

[73] Assignee: General Electric Company, Schenactady, N.Y.

[21] Appl. No.: 504,765

[22] Filed: Apr. 5, 1990

[51] Int. Cl.[5] ..... H04R 17/00

[52] U.S. Cl. ..... 367/153; 367/155; 310/334; 29/25.35; 128/662.03

[58] Field of Search ..... 367/140, 153, 155, 138, 367/103; 310/334; 29/25.35; 128/662.03, 660.01, 661.01, 24 A

[56] References Cited

U.S. PATENT DOCUMENTS

| | | | |
|---|---|---|---|
| 3,059,130 | 10/1962 | Robins | 367/153 |
| 4,371,805 | 2/1983 | Diepers et al. | 310/334 |
| 4,398,325 | 8/1983 | Piaget et al. | 29/25.35 |
| 4,570,488 | 2/1986 | Miwa et al. | 128/661.01 |
| 4,658,176 | 4/1987 | Nakaya et al. | 310/334 |
| 4,747,192 | 5/1988 | Rokurota | 310/334 |

*Primary Examiner*—Deborah Kyle
*Assistant Examiner*—J. Woodrow Eldred
*Attorney, Agent, or Firm*—Marvin Snyder; James C. Davis, Jr.

[57] ABSTRACT

In a phased array acoustic transducer which has elements of different sizes, the piezoelectric material of large elements is subdiced to produce smaller segments to limit the overall piezoelectric segment size variation within the array to up to 55% or more without significant adverse effect on phased array processsing.

15 Claims, 10 Drawing Sheets

PHASED ARRAY ULTROSONIC TRANSDUCER INCLUDING DIFFERENT SIZED PHEZOELECTRIC SEGMENTS

RELATED U.S. PATENTS AND PATENT APPLICATIONS

This application is related to U.S. patent application Ser. No. 07/504,750, entitled "An Ultrasonic Array With a High Density of Electrical Connections", by L. S. Smith et al., filed concurrently herewith; and U.S. Pat. No. 4,890,268, entitled "Two-Dimensional Phased Array of Ultrasonic Transducers", by L. S. Smith, W. E. Engeler and M. O'Donnell. This application and this patent are each incorporated herein by reference in its entirety.

BACKGROUND OF THE INVENTION

1. Field of the Invention

This invention relates to the field of ultrasonic transducers, and more particularly, to the field of phased array ultrasonic transducers.

2. Background Information

Array transducers, whether they be ultrasonic transducers as in the case of ultrasonic imaging, or electromagnetic radiating horns as in the case of phased array radars, rely on wave interference for their beam forming effects. The ability to provide a focused beam on transmission and to provide a clear image on reception is dependent on each of the elements of the array having identical transduction characteristics between the electrical signals provided by the system transmitter and the wave transmitted into the medium to be explored and identical transduction functions from a wave in the medium being explored to an electrical signal provided to the signal processing system. It is only when the elements have identical characteristics that phased array combining of the signals from a plurality of elements will provide a clear image. The element characteristics which is used to compare elements is the element impulse response. That is, the element's response when a brief high amplitude electrical or wave pulse is applied to the element.

It is because of this theoretical basis for phased array processing, imaging, and coherent beam forming that phased arrays are fabricated from a plurality of elements having identical impulse responses. Since large and small objects react differently, the prior art has satisfied this requirement by using physically identical transducers in order to provide identical impulse responses.

Initially, ultrasonic transducers were individual, stand alone transducers. For imaging and surveillance purposes, linear arrays of ultrasonic transducers and two-dimensional arrays of ultrasonic transducers were developed, along with appropriate electronics, to provide images of objects whose characteristics it was desired to determine. Early two-dimensional ultrasonic arrays were relatively large structures in which individual, identical elements of the array were separately fabricated and then assembled into an array which was suitable for use in such large scale systems as sonar.

In such arrays, individual elements had a height of a wavelength or more. In this specification, as will be discussed subsequently in greater detail, the thickness of a piezoelectric array element is defined as being perpendicular to the face of the array, the width of an array element is defined as the narrow dimension of the element which is disposed parallel to the face of the array and the height of the element is defined as the long dimension of the element which is disposed parallel to the face of the array.

In elements having a width that is in the vicinity of a wavelength of longer, the thickness acoustic vibrations of the piezoelectric element and the width vibrations of the piezoelectric material couple to each other resulting in undesirable piezoelectric transducer characteristics. In prior art linear arrays of this type, it was found that this coupling between the thickness and width modes of the acoustic vibrations in the piezoelectric material could be suppressed by subdicing the elements of the array into segments of piezoelectric material in which each segment of the piezoelectric material is the same size and with a maximum width on the order of half the thickness. Consequently, such linear arrays are normally subdiced to improve their electro-acoustic characteristics. By subdicing, we mean cutting most of the way through the piezoelectric material, preferably without going all the way through it. This separates the piezoelectric into acoustically separate segments, while preferably leaving it as a unitary structure. The separate segments of an element have their signal electrodes connected together in order to function as a single electrical element.

When interest developed in the use of ultrasound as a medical imaging tool, much smaller arrays and elements were required than were used in prior art ultrasonic phased arrays.

There are two different kinds of ultrasonic imagers which use linear transducer arrays. The first is a rectilinear scanner in which a subarray consisting of a specified number of elements is selected and focused, usually without steering, i.e. with the beam direction perpendicular to the plane of the array face. An electrical signal is applied to each of the elements of this subarray to induce the transmission of a beam of ultrasound into the object to be examined and the reflection of that beam is received by the same subarray and converted to electrical signals which contribute to the generation of an image. A new subarray is then selected and the process repeated until the desired rectangular image can be generated. Typically, successive subarrays of N elements each have $N-1$ elements in common such that each successive subarray drops one element from the previous subarray while adding the next element in the array. Typically, these transducer elements have widths which are greater than $\lambda$ in the object to be examined and are subdiced as described in the previous paragraph to obtain desired element response characteristics.

The second kind of linear array is a phased array sector scanner in which all of the transducer elements are used simultaneously to form a steered beam. In this type of array, the individual element widths have to be small ($\sim\lambda/2$ in water) in order for the beam formation process to be effective. It is linear arrays of this second kind which are most similar to the two dimensional phased arrays to which the present invention is directed.

Medical ultrasonic arrays are typically linear arrays of elements formed from a single block of piezoelectric material which is appropriately processed to produce an array of physically connected, but electrically substantially independent, acoustic transducers. Each of these transducers is separately connected to the system electronics either for generation of sound for transmission into the body to be examined or for reception of sound from the body being examined, or both.

As the diagnostic use of ultrasound has progressed, a need has developed for greater resolution and image clarity. Typical medical linear acoustic phased array transducers have elements that are small enough that coupling between the thickness and the width modes of the acoustic vibrations in the piezoelectric material are not a problem.

In typical prior art linear acoustic phased array transducers for medical purposes, the array has narrow, closely spaced elements disposed along its X-direction length which are capable of focusing the acoustic beam in the X-direction at a particular depth and/or steering the acoustic beam to a particular location in the X-direction (along the length of the linear array). However, perpendicular to the length of the linear array (Y-direction), focus was provided by a fixed acoustic lens having a fixed focal depth with the result that focusing the linear array at a substantially shallower or substantially greater depth resulted in a lack of focus in the Y-direction. No Y-direction steering is provided.

Related U.S. Pat. No. 4,890,268 overcame this Y-direction focus problem by providing a two-dimensional acoustic array transducer of medical dimensions which is capable of focusing a 5 MHz acoustic beam in the desired manner in both directions, while steering it in the X-direction. The two-dimensional array of that patent is an approximation to a circular Fresnel lens. As such, it may be looked upon as being formed of a plurality of linear X-direction acoustic phased array transducers stacked in the Y-direction. As is illustrated in FIG. 1, in order to form an accurate approximation to a circular Fresnel lens, the individual subarrays have differing heights in the Y-direction. In accordance with phased array theory, this structure would have unusable because different subarrays would have had different element impulse responses since the patent uses elements which vary by more than 3 to 1 in size.

U.S. Pat. No. 4,890,268 avoids the problem of differing impulse responses in the elements of the different subarrays by forming each of the elements from a plurality of uniform width piezoelectric segments in which all dimensions except the thickness dimension are less than about half a wavelength. This is accomplished by forming that transducer from a 2—2 composite of piezoelectric slabs and electro-acoustically inert slabs. A 2—2 composite is one in which the material of each of its two components is connected to itself over large distances in only two perpendicular directions. That is, the structure from which that array is formed is essentially a laminate of multiple piezoelectric slabs interleaved with multiple slabs of an acoustically inactive material such as epoxy. The transducer is then formed by subdicing and dicing this laminate structure to produce the desired pattern of array elements. The impulse response of each element is determined by the impulse response of the individual piezoelectric segments. Thus, U.S. Pat. No. 4,890,268 follows the prior art pattern of using "identical" elements by incorporating a plurality of physically identical piezoelectric segments in each of its electrical elements in order that the impulse response of all the elements will be identical, despite their differing physical size. While this structure is precise in providing identical impulse responses for all of the electrical elements, it is complex and relatively expensive to manufacture. A transducer structure retaining the benefits of U.S. Pat. No. 4,890,268 array structure while simplifying the manufacturing process and reducing the manufacturing cost would be highly desirable.

OBJECTS OF THE INVENTION

Accordingly, a primary object of the present invention is to provide a less complex, less expensive structure for a two-dimensional ultrasonic transducer array.

Another object of the present invention is to provide a less complex, less expensive structure for a two-dimensional ultrasonic transducer array which approximates a Fresnel lens.

Another object of the present invention is to obviate the need for identical element responses in a phased array system in order to provide clear images by providing an array in which the element characteristics are non-identical, but sufficiently similar to conform to phased array theory in a practical system.

A still further object of the present invention is to provide an ultrasonic array transducer comprised of piezoelectric segments of differing sizes.

SUMMARY OF THE INVENTION

The above and other objects which will become apparent from the specification as a whole, including the drawings, are achieved in accordance with the present invention by a phased array ultrasonic transducer having array elements formed of different sized segments of piezoelectric material while still providing impulse responses which are sufficiently identical to be suitable for phased array processing. Elements having physical sizes which vary by a factor of as much as 4 to 1 are provided with sufficiently identical impulse responses by subdicing large elements to keep segment size variations to less than about 55%.

For example, in the array structure of U.S. Pat. No. 4,890,268, the height of the inner or tallest subarray is 375% of the height of the outer or shortest subarray. When the inner subarray is subdiced to divide each element into three subelements which are electrically connected in parallel, the segment size variation is reduced to 55% for the overall array. The resulting impulse response characteristics enable the production of high quality phased array processed images.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION

Figure 1:
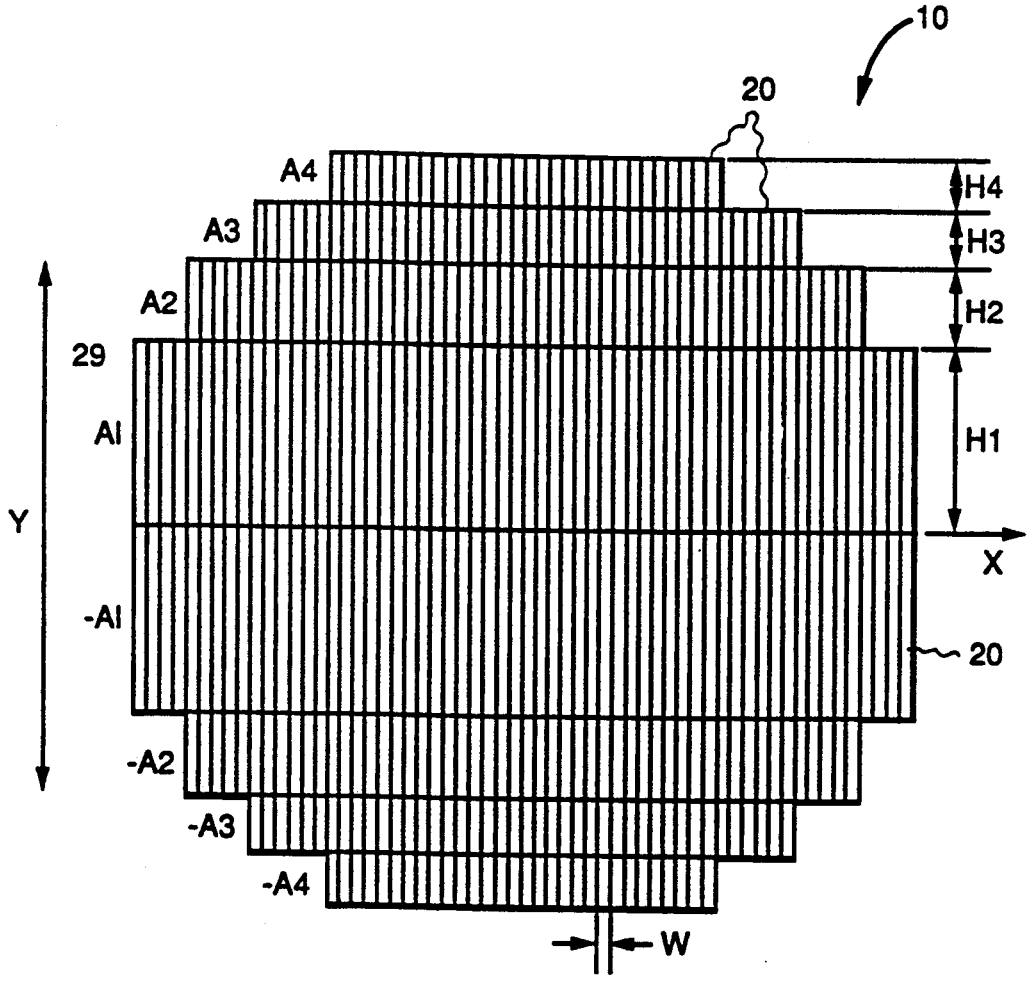
FIG. 1 PRIOR ART
FIG. 1 is a face-on view of a ultrasonic phased array transducer of the general type disclosed in U.S. Pat. No. 4,890,268.

In FIG. 1, a phased array ultrasonic transducer 10 is illustrated in front plan view (that is, face-on to the array). This array comprises eight rows or subarrays of ultrasonic elements 20, these rows being designated $\pm A_1$, $\pm A_2$, $\pm A_3$ and $\pm A_4$ where the minus sign indicates a subarray which is disposed below the X-axis (along the minus Y-axis) in the figure. In accordance with U.S. Pat. NO. 4,890,268, for use at an acoustic frequency of 5 MHz, the subarray $A_1$ is 150 mils high and comprises 84 elements; the subarray $A_2$ is 62 mils high and comprises 74 elements; the subarray $A_3$ is 48 mils high and comprises 60 elements; and the subarray $A_4$ is 40 mils high and comprises 42 elements.

Figure 2:
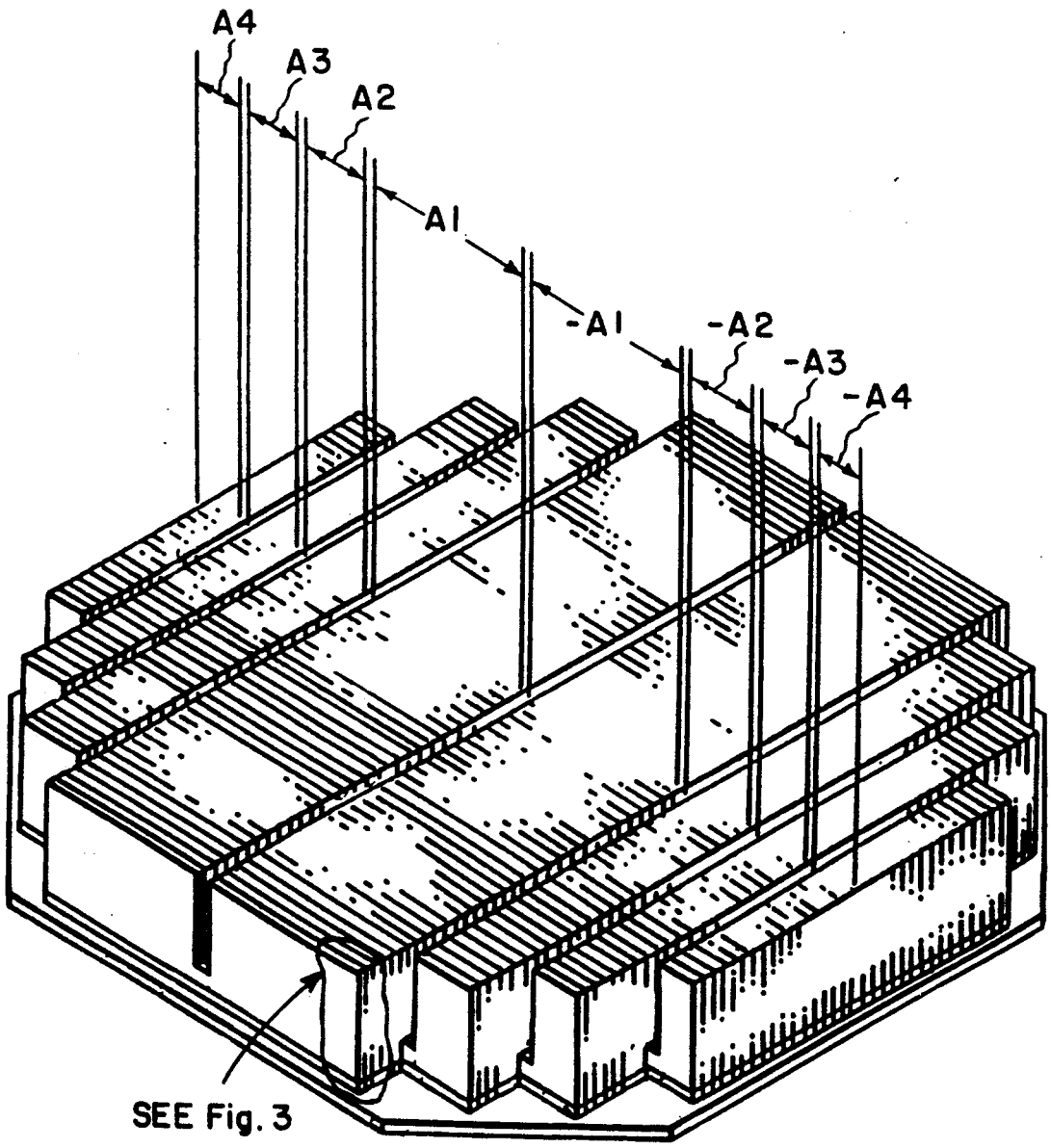
FIG. 2 PRIOR ART
FIG. 2 is a perspective illustration of the transducer of FIG. 1.
Figure 3:
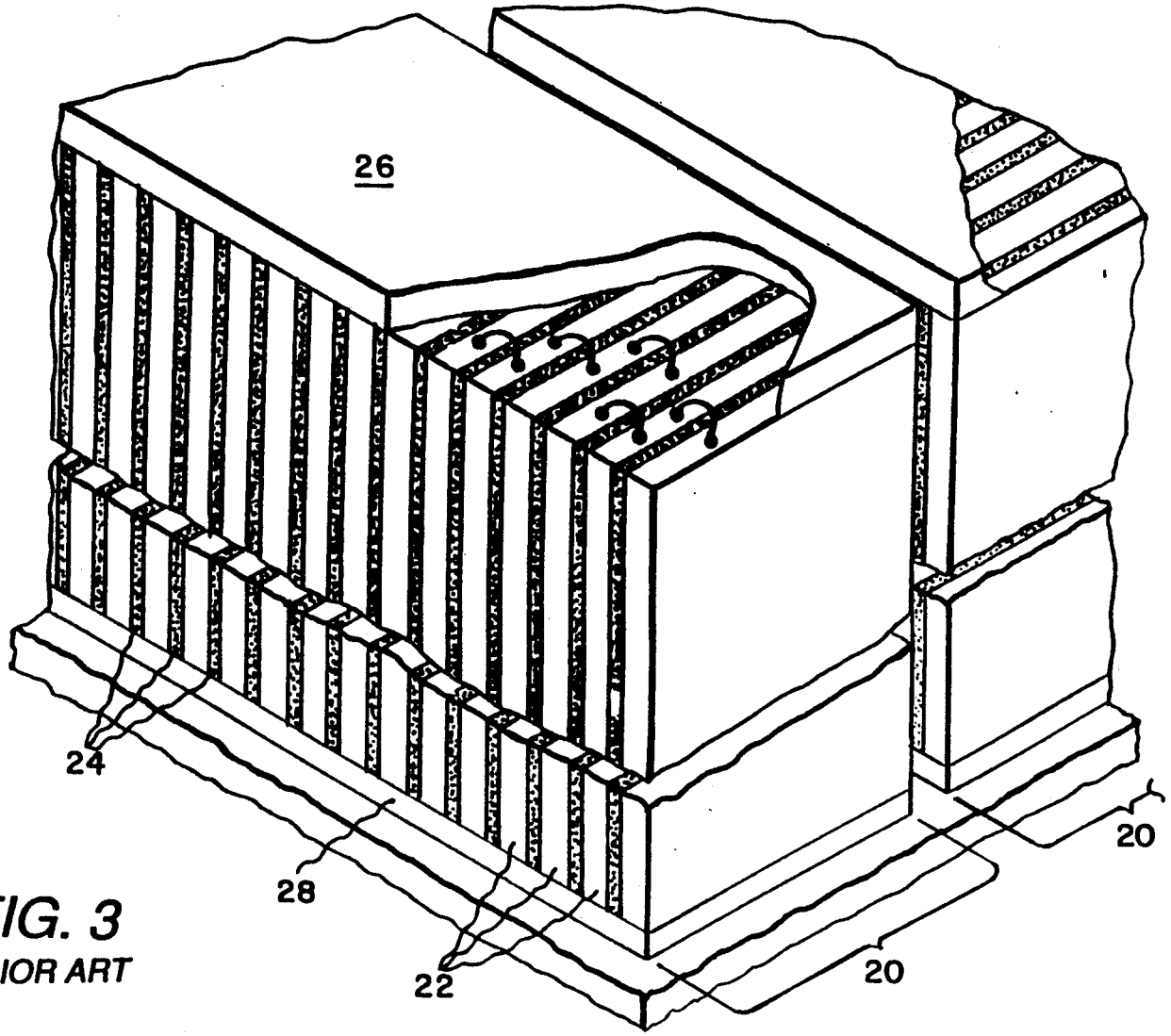
FIG. 3 PRIOR ART
FIG. 3 is an enlarged view of the portion of the FIG. 2 structure within the circle 3.

FIG. 2 is a perspective illustration of the array of FIG. 1. This illustration more clearly illustrates the subdicing employed to separate the initial structure into the eight Y-direction subarrays $\pm/A_1$-$\pm A/4$. Details of the structure of two X-direction adjacent elements of the array 10 of FIG. 2 are illustrated in FIG. 3. The portion of FIG. 2 which is enlarged in FIG. 3 is within the circle 3 in FIG. 2.

As can be seen in FIG. 3, each element is comprised of a plurality of plates 22 of piezoelectric material which are spaced apart by layers 24 of electro-acoustically inactive material which may preferably be epoxy. Each of the plates 22 is essentially identical to every other plate 22 in the entire array. As a consequence of this element construction, each element is comprised of a plurality of piezoelectric segments or subelements which are substantially physically identical as a result of which they have substantially identical impulse responses. As a consequence, for the same acoustic stimulation, the electrical waveform produced by each of the elements is substantially identical.

It will be understood that the electrical signals produced by the individual elements of this acoustic phased array transducer are electrically combined with appropriate phase and amplitude adjustment in order to produce a beam which is directed at a particular location and focused at that location. In a similar manner, the source signal which is used to produce a probing ultrasonic beam is divided in an appropriate phase and amplitude manner to supply individual signals to the individual elements of the transducer array in order to produce a sound wave which is directed at a desired location and focused at that location.

This structure is highly effective in providing the identical impulse response characteristics which are required for accurate phased array processing. However, the fabrication process for this array is quite complex, and subject to yield problems since the individual segments of piezoelectric material are 16 mils thick by 3 mils high by 5.1 mils wide and are formed from a unitary block of piezoelectric material by cutting grooves 16 mils deep and 1 mil wide on 4 mil centers to form an array which is 600 mils (0.6 inch) high in the Y-direction by 600 mils long in the X-direction.

Following the cutting of those grooves, the grooves are filled with epoxy 24 which is electro-acoustically inert. After the epoxy cures, a bottom portion of the piezoelectric material disposed below the 16 mils depth of the saw cuts is ground off to leave totally separate slabs of piezoelectric material having dimensions 3 mils by 16 mils by 600 mils which are held together in the laminate structure by the epoxy 24. This structure is metallized on its top and bottom surfaces to provide the signal electrodes 26 and the ground electrode 28 for the structure. After laminating this structure to a set of front surface acoustic matching layers the piezoelectric portion of the resulting structure is cut partway through along the separation lines between the eight different subarrays to separate the structure into the eight subarrays. These grooves preferably extend most of the way, but not all the way through the structure. Then a backing material which is preferably an acoustic damper at the intended operating frequency is attached to the back of this structure to provide support and damping. The front matching layers and the piezoelectric portion of this overall structure are then diced in a perpendicular direction to separate the individual columns of the array from each other. In the process, the ground electrode is cut into separate ground electrodes for each column as are the signal electrodes. The structure is held together as a unitary structure by the acoustic matching backing material. Because most piezoelectric materials are relatively brittle and because of voids, inclusions and other imperfections in these ceramic materials, the structure is subject to a substantial risk of breaking during the initial slicing process which produces the individual piezoelectric slabs. A more detailed description of this type of fabrication process is contained in U.S. Pat. No. 4,211,948, issued to L. S. Smith and A. F. Brisken and entitled, "Front Surface Matched Piezoelectric Ultrasonic Transducer Array With Wide Field Of View". That patent is incorporated herein by reference in its entirety.

If rather than being fabricated from such individual slabs the array was produced from a monolithic block of piezoelectric material by just the subarray-forming partial saw kerfs and the column-separating full saw kerfs, the individual slabs of piezoelectric material would have a thickness T of 16 mils, a width W of 5.1 mils and a height H of from 40 to 150 mils, with the height depending on the particular subarray in which that segment of piezoelectric material was disposed. As such, less risk of breakage would be encountered, with the resulting higher array yield as well as simplifying the fabrication process and reducing its cost. However, the resulting structure would be expected to have substantially different impulse responses for each of the four subarrays because of their differing segment sizes.

Figure 4:
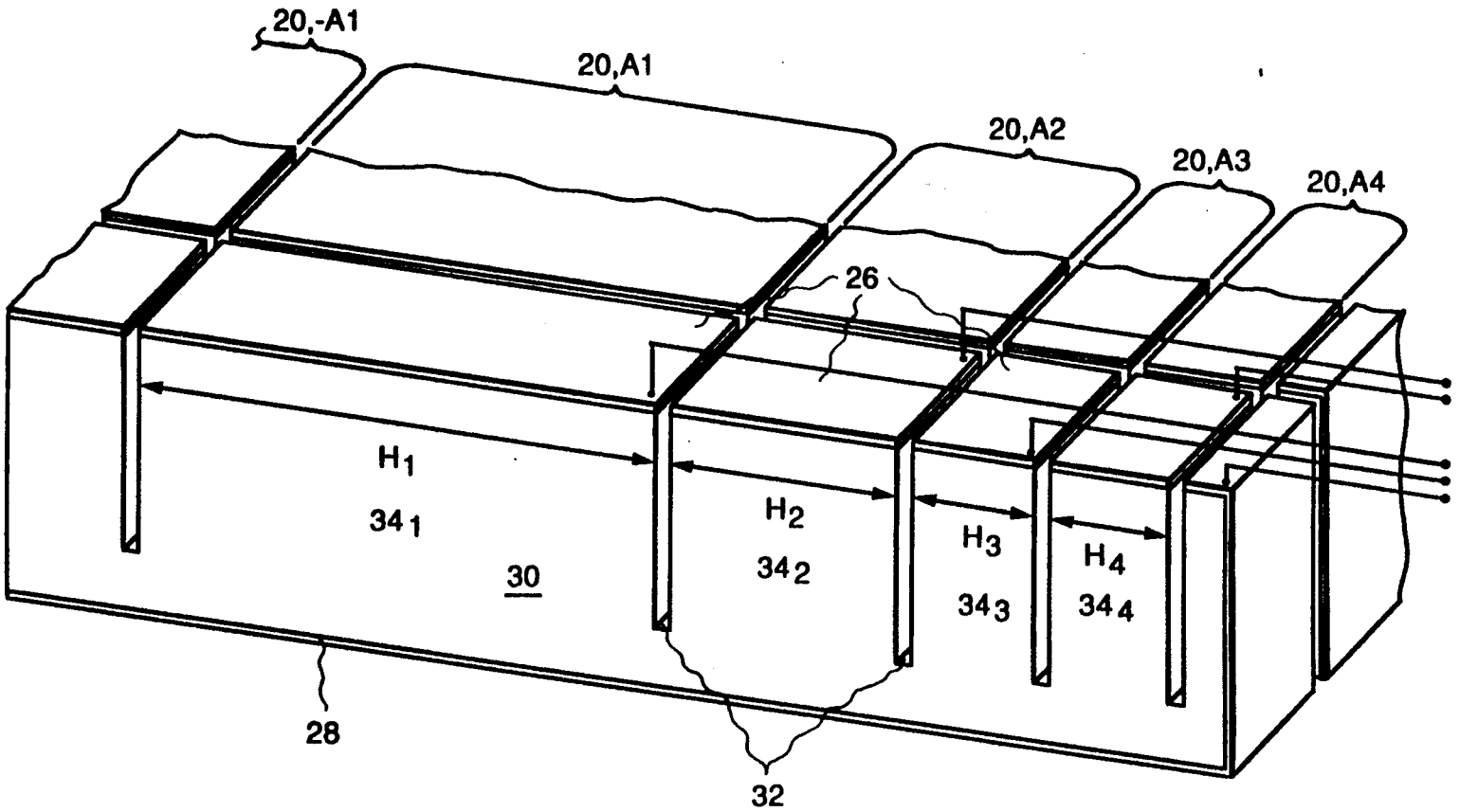
FIG. 4 is a perspective view of two columns of an array similar to that in FIG. 2.

FIG. 4 illustrates portions of two columns of an array structure like that of FIGS. 1 and 2, but fabricated from a monolithic block of piezoelectric material without first forming the 2—2 composite. By monolithic, we mean that each of the segments of piezoelectric material is a unitary body of piezoelectric material and not a composite such as that taught in U.S. Pat. No. 4,890,268. Individual partial saw kerfs 32 divide the piezoelectric body 30 into the separate electrical elements 20 of subarrays $A_1$-$A_4$ which consist of piezoelectric segments $34_1$-$34_4$. In this structure, the element 20 for the subarray $A_1$ has a height $H_1$ which may be 150 mils; the element 20 for the subarray $A_2$ has a height $H_2$ which may be 62 mils; the element 20 for the subarray $A_3$ has a height $H_3$ which may be 48 mils and the element 20 for the subarray $A_4$ may have a height of $H_4$ of 40 mils. A single ground electrode 28 extends along the lower surface of the piezoelectric body and up the end surface of the piezoelectric body onto the upper surface where it is separated from the element 20 of the subarray $A_4$ by a partial saw kerf 42. In this way, the ground conductor for the column is accessible at the back face of the array. On the back face of the array, separate signal conductors 26 for the individual elements are separated from each other by the partial saw kerfs 32. These partial saw kerfs preferably extend about 80% of the way through the thickness of the piezoelectric body and should not extend about ⅔ of the way through the block since that would leave a bridge thickness $T_B$ of ⅓T. The fundamental wavelength in a bridge T/3 thick between adjacent segments would be the same as the wavelength of the third harmonic in the adjacent segments—a situation which would tend to produce cross-talk between adjacent segments.

Figure 5:
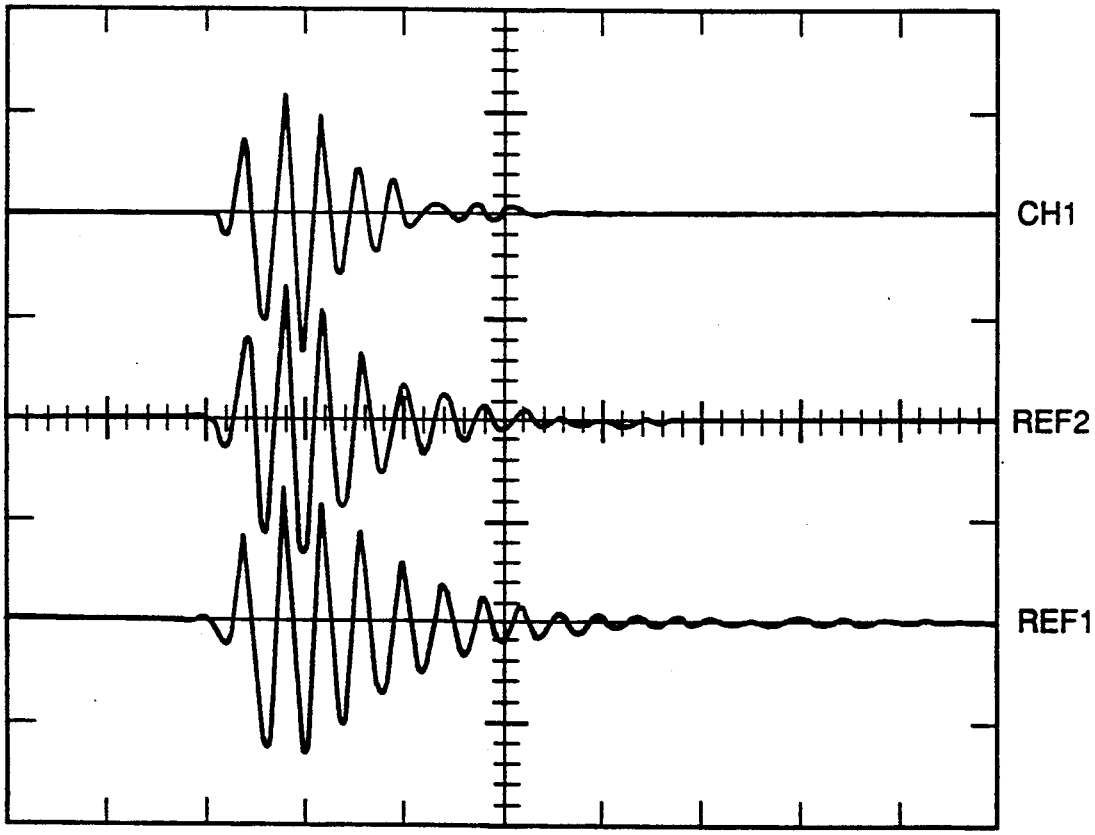
FIG. 5 illustrates the electrical impulse responses of three piezoelectric segments having different heights.
Figure 8:
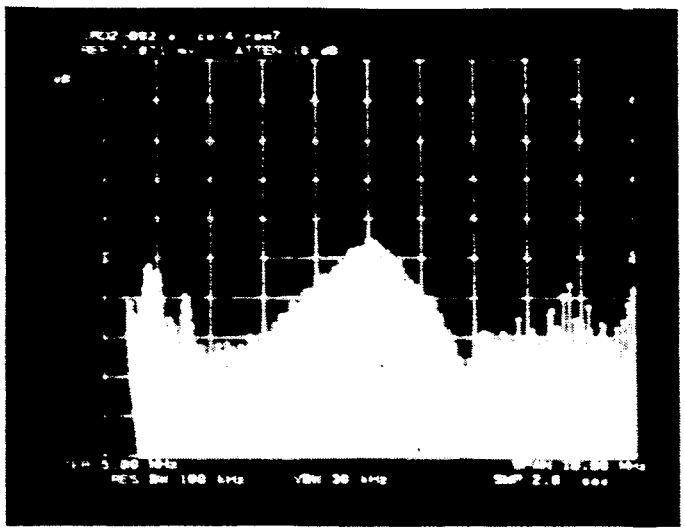
FIGS. 6, 7 and 8 illustrate the spectra of the three waveforms in FIG. 5.
Figure 7:
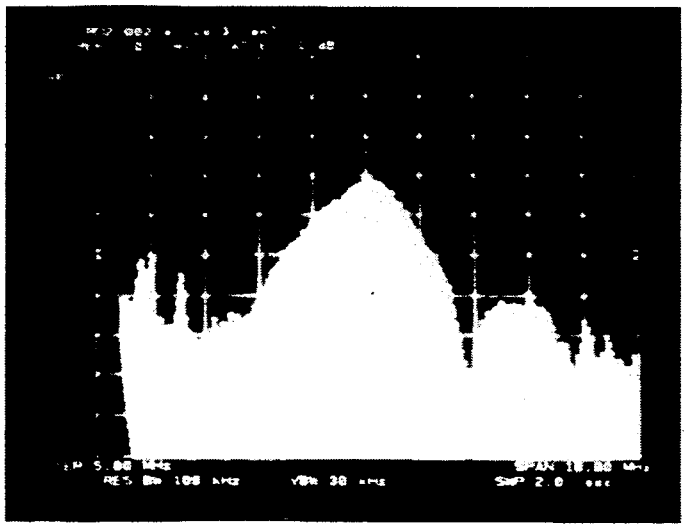
Figure 6:
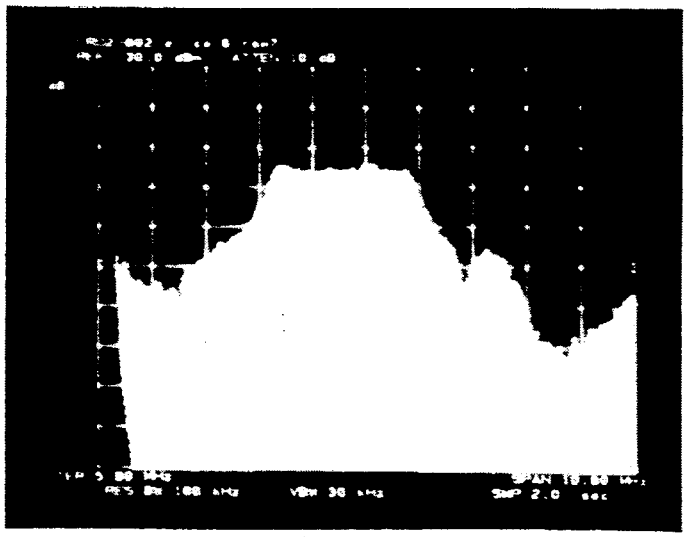

The ground conductor 28 and the signal electrodes 26 may preferably initially comprise a single continuous metallization of the exterior surface of the piezoelectric body which is divided into the separate electrodes by the partial saw kerfs 32. The impulse response waveforms produced by three elements 20 of this general type having differing heights are illustrated in FIG. 5. The spectrums for these three waveforms are illustrated in FIGS. 6, 7 and 8. As can be seen, the spectrum in FIG. 6 is substantially wider than that in FIGS. 7 and 8 with the result that elements of this type, if used in a phased array transducer, would significantly degrade system performance since their output would not combine properly in the phased array beam forming process. This difference in impulse responses is partially a result of coupling between the thickness and height modes of acoustic vibration within the piezoelectric material.

Figure 9:
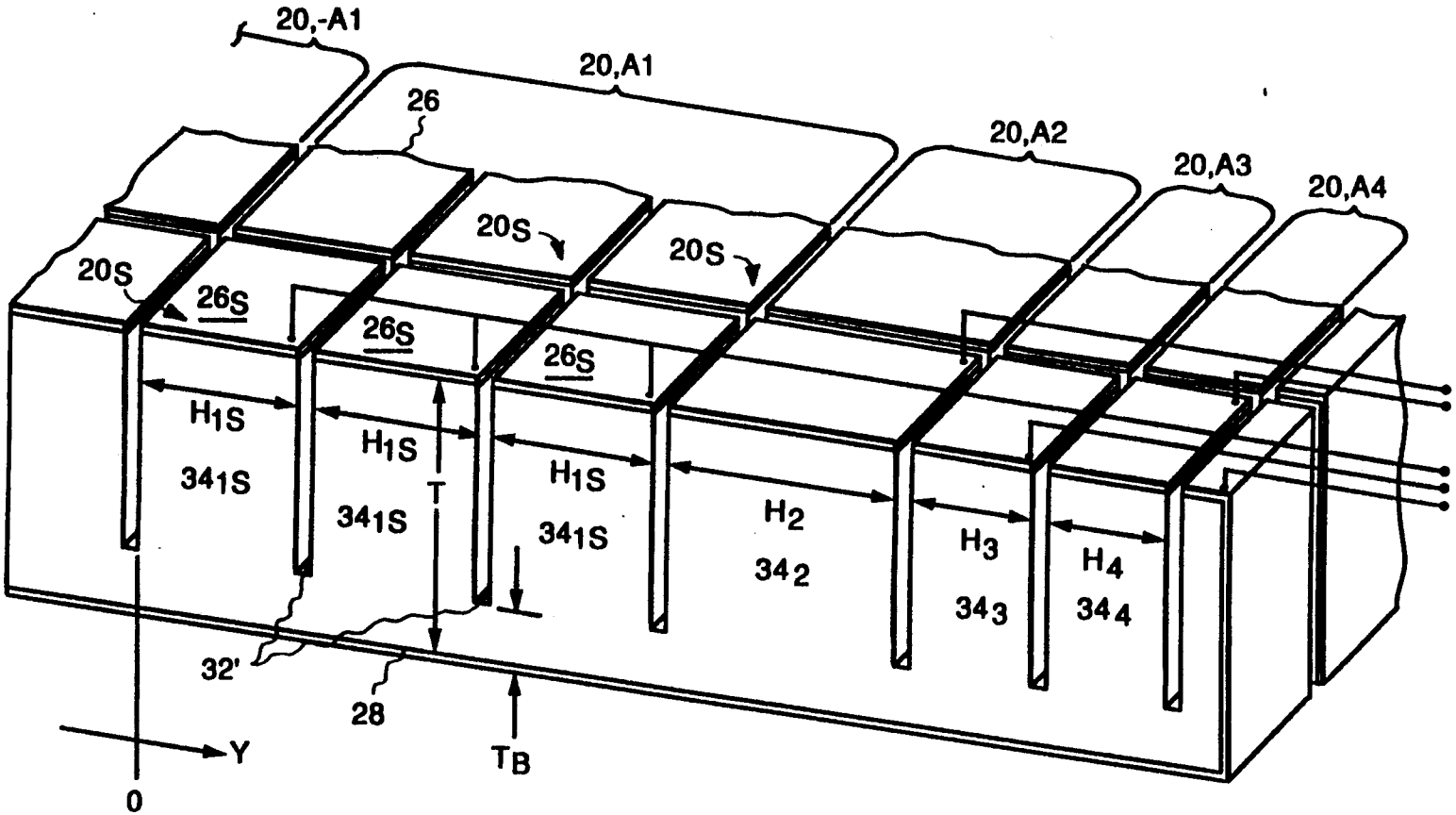
FIG. 9 illustrates two columns of an array like that of FIG. 2 fabricated in accordance with the present invention from a single monolithic block of piezoelectric material in which elements having a large height are subdiced.

A modified (from FIG. 4) column structure for a phased array transducer of the type illustrated in FIGS. 1 and 2 is illustrated in perspective view in FIG. 9. The FIG. 9 structure is the same as the FIG. 4 structure with the exception of the introduction of two additional partial saw kerfs 32' which divide the element 20 for the subarray $A_1$ into three subelements $\mathbf{20}_s$, each of which is a segment $\mathbf{34}_{1s}$ of the piezoelectric material having a height $H_{1s}$. The heights $H_2$, $H_3$ and $H_4$ of the elements for the other subarrays remain unchanged, since they have not been subdiced. This subdicing of the elements of the $A_1$ subarray into the subelements $\mathbf{20}_s$ reduces the height of the segments $\mathbf{34}_{1s}$ in the element of subarray $A_1$ from 150 mils ($\mathbf{34}_1$) to 50 mils ($\mathbf{34}_{1s}$) or about midway between the heights of the subarray $A_4$ at 40 mils and the subarray $A_2$ at 62 mils. When the column is subdiced in this manner the heights of all of the segments become substantially the same, i.e. $H_{1s} \approx H_2 \approx H_3 \approx H_4$, the coupling between thickness and other vibration modes is similar with the result that the elements of each of the subarrays have substantially the same impulse response.

It will be noted that our use of the term "segment" in connection with the piezoelectric material encompasses either a segment such as is illustrated in FIGS. 4 and 9 which is acoustically separate, although physically attached to other segments by the bridging portion of the piezoelectric body and segments which are totally separated from other segments of the piezoelectric material.

We prefer to use partial saw kerfs rather than complete saw kerfs to separate a column into separate elements or subarrays because this facilitates the connection of a ground electrode to each of the elements of a column, since they remain continuous along the ground electrode 28. If a different means of providing an electrical connection to the electrodes on the front face of the piezoelectric material were provided (such as an electrically conductive matching layer), the partial saw kerfs 32 could be made full depth saw kerfs without causing any adverse effect on the operation of this phased array transducer.

The three signal electrodes $\mathbf{26}_s$ for the three subelements $\mathbf{20}_s$ which form the element of array $A_1$ are electrically connected together for beam forming and signal processing purposes. The resulting array structure is illustrated in face-on view in FIG. 10 where the three subelements $\mathbf{20}_s$ of each element of the $A_1$ array are separated by horizontal saw kerfs. Electrically, the three subelements of an element of the array $A_1$ are connected together to provide an array which has the electrical structure illustrated in FIG. 1. As a result, rather than 7 partial saw kerfs being used to convert the structure into the subarrays, 11 partial saw kerfs are employed.

Figure 10:
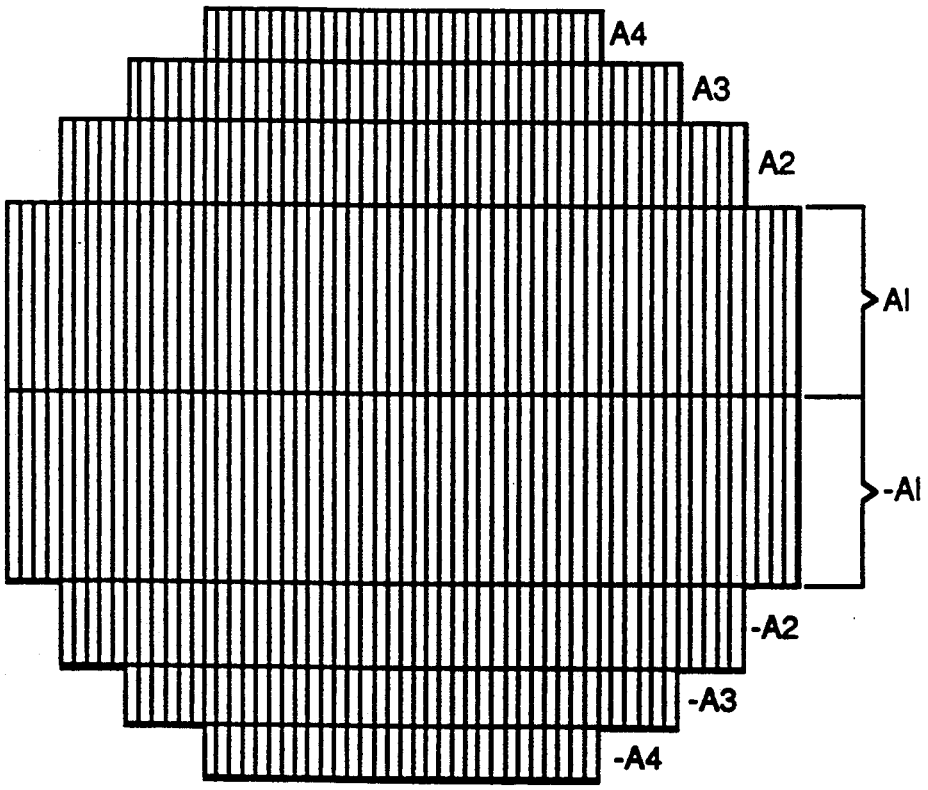
FIG. 10 is a face-one view of an ultrasonic arrays of the type illustrated in FIG. 1 constructed in accordance with the present invention.
Figure 11B:
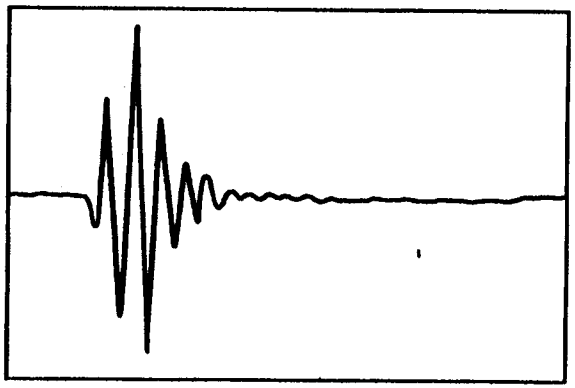
FIGS. 11A-11D illustrate the impulse responses of the four different element sizes illustrated in FIG. 9.
Figure 11A:
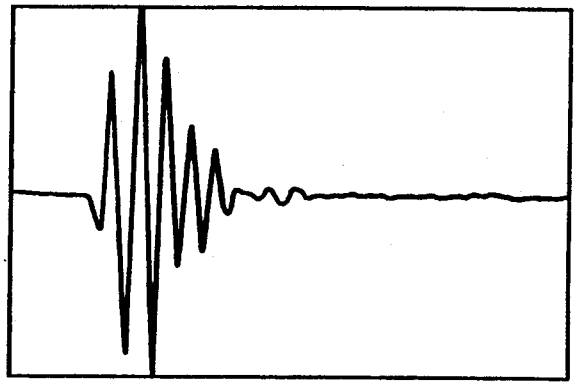
Figure 11D:
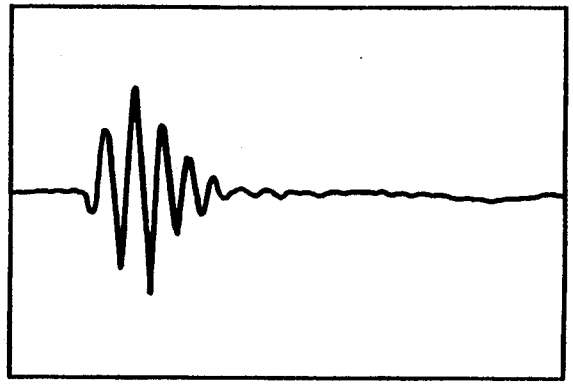
Figure 11C:
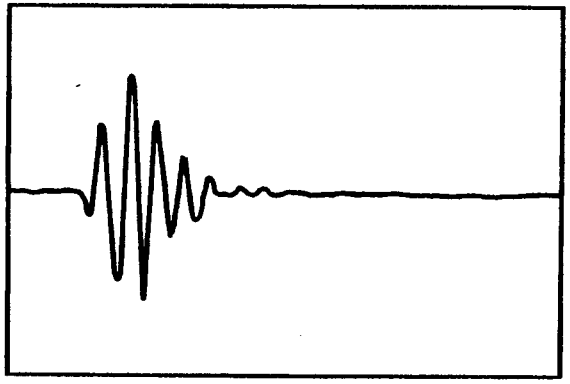
Figure 12B:
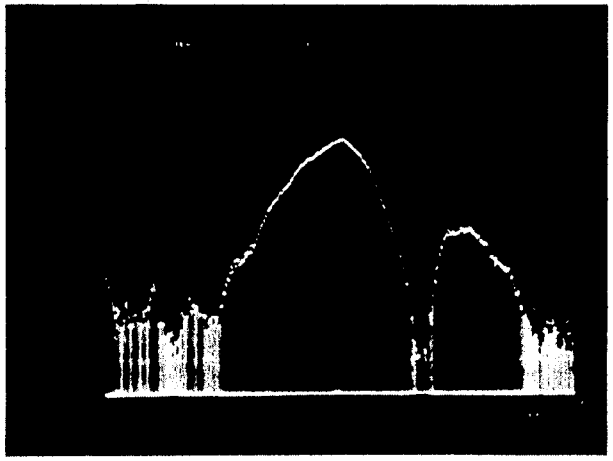
FIGS. 12A-12D illustrate the spectra of those impulse responses.
Figure 12A:
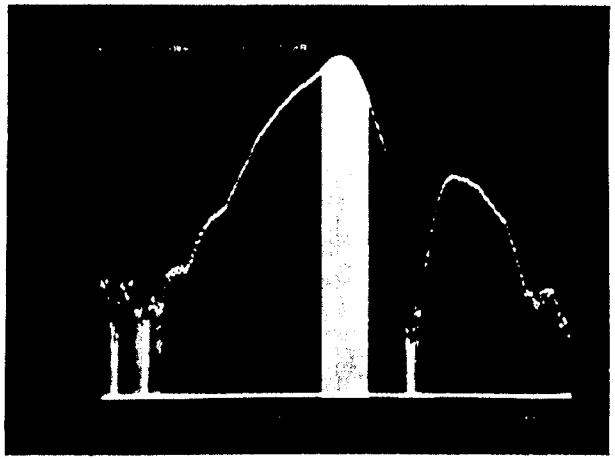
Figure 12D:
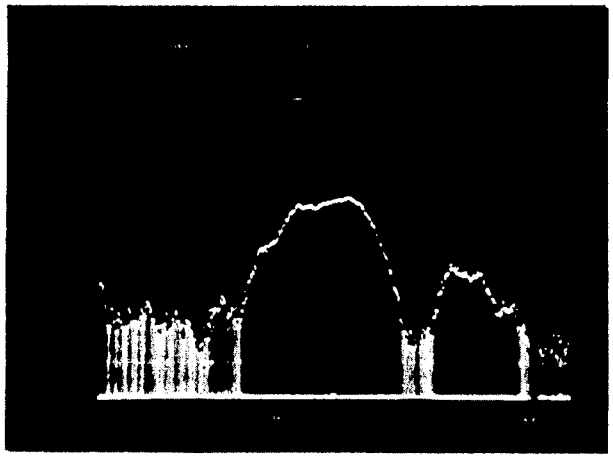
Figure 12C:
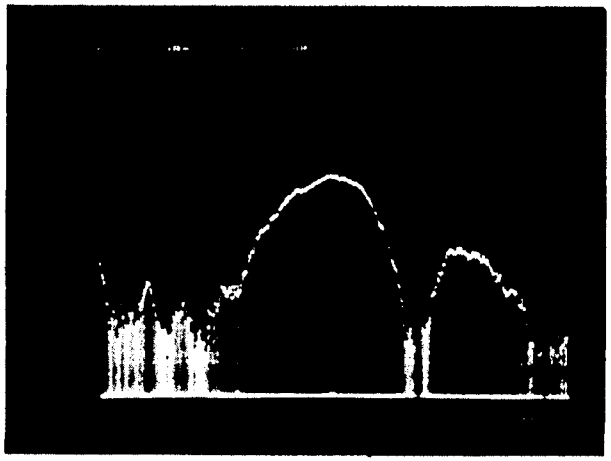

Impulse response waveforms for elements of the four different subarrays of the FIGS. 9 and 10 structure are illustrated in FIGS. 11A–11D. The waveform shown in FIG. 11A is that produced by elements of the $A_1$ subarray, the waveform of FIG. 11B is that produced by elements of the subarray $A_2$ subarray, the waveform of FIG. 11C is that produced by elements of the subarray $A_3$ and the waveform in FIG. 11D is that produced by elements of the subarray $A_4$. Corresponding spectra for the signals are illustrated in FIGS. 12A–12D with the figures ending in the same letter being for the same subarray. As can be seen, these waveforms are substantially identical both in the time domain and frequency domain with the result that they can be processed in accordance with phased array techniques to provide a well focused ultrasonic beam when being used to produce a probing ultrasonic beam and may be combined to provide a clear image when the return sound from an ultrasonic probe beam is being converted to an electrical signal for conversion into an image of the object being probed.

This array is substantially less complex and substantially less expensive to fabricate than the array of U.S. Pat. No. 4,890,268. However, since the impulse responses for the various subarrays are only approximately identical rather than strictly identical, the ultimate obtainable system performance, assuming system performance were limited by the transduction characteristics of the individual elements in both cases, would be less in the case of the present array transducer than in the case of the one of U.S. Pat. No. 4,890,268. However, for many applications, the present transducer will be more desirable because it is less expensive to produce and does not limit system performance in those systems.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. An ultrasonic transducer comprising:

a plurality of segments of electro-acoustically active material, said plurality including first and second segments;

a plurality of electrically independent ultrasonic transducer elements arranged in an array;

each of said elements comprising at least one of said segments, a signal electrode and a ground electrode, and at least one of said elements including more than one of said segments electrically connected together so as to operate as a single element; and said second segment having a height which is at least 110% of the height of said first segment, said height being measured parallel to the face of the array.

2. The ultrasonic transducer recited in claim 1 wherein:

a third one of said segments has a height which is at least 120% of the height of said first segment.

3. The ultrasonic transducer recited in claim 1 wherein:

a fourth one of said segments has a height which is at least 140% of the height of said first segment.

4. The ultrasonic transducer recited in claim 1 wherein:

said fourth segment height is at least 150% of the height of said first segment.

5. The ultrasonic transducer recited in claim 1 wherein:

said elements are arranged in rows and columns;

the elements of a column comprise portions of a monolithic structure;

within a column, the column-direction length of said elements varies over a range of at least 1.6 to 1 within one column;

adjacent elements of said column are separated from each other by gaps which extend from a first surface of said monolithic structure toward a second surface of said monolithic structure;

a first element of said column is split into multiple segments in the column-length direction electrically connected together so as to operate as a single element, adjacent ones of said segments being spaced apart by a gap which extends from the first surface of said monolithic structure toward the second surface of said monolithic structure; and a second element of said column consists of a different number of segments than said first element and a first element segment is a different size than a second element segment.

6. The ultrasonic transducer recited in claim 5 wherein:

said first element has a single signal conductor associated therewith and that signal conductor is ohmically connected to all of the segments of said first element.

7. The ultrasonic transducer recited in claim 5 wherein:

first and second segments of said first element have first and second signal conductors, respectively, associated therewith, said first signal conductor being disposed in ohmic contact with a single electrode of said first segment and said second signal conductor being disposed in ohmic contact with a signal electrode of said second segment.

8. The ultrasonic transducer recited in claim 5 wherein:

said second element consists of only one segment.

9. The ultrasonic transducer recited in claim 5 wherein:

said gaps which separate adjacent elements of a column do not extend all the way through said monolithic structure.

10. The ultrasonic transducer recited in claim 5 wherein:

said gaps which separate adjacent elements of a column extend all the way through said monolithic structure.

11. The ultrasonic transducer recited in claim 5 wherein:

said gap which separates adjacent segments of an element of a column does not extend all the way through said monolithic structure.

12. The ultrasonic transducer recited in claim 5 wherein:

said gap which separates adjacent segments of an element of a column extends all the way through said monolithic structure.

13. An ultrasonic transducer comprising:

a plurality of segments of electro-acoustically active piezoelectric material;

a first element consisting of a single segment of piezoelectric material; and a second, electrically independent, element comprising two segments of piezoelectric material electrically connected together so as to operate as a single element.

14. The transducer recited in claim 13 wherein:

said second element consists of three segments of piezoelectric material electrically connected together so as to operate as a single element.

15. In a method of fabricating an ultrasonic phased array transducer of the type comprising a plurality of electrically independent elements derived from a common body of piezoelectric material in which the method includes a step of subdicing large elements of said array into plurality of segments, the improvement comprising:

subdicing a large element into segments which are a different size than a segment in another element and which are electrically connected together to operate as a single element.

* * * * *

UNITED STATES PATENT AND TRADEMARK OFFICE

CERTIFICATE OF CORRECTION

PATENT NO. : 5,099,459

DATED : March 24, 1992

INVENTOR(S) : Lowell Scott Smith

It is certified that error appears in the above-identified patent and that said Letters Patent is hereby corrected as shown below:

Title page, item [54], and col. 1, lines 1-3, should read --PHASED ARRAY ULTRASONIC TRANSDUCER INCLUDING DIFFERENT SIZED PIEZOELECTRIC SEGMENTS--.

On title page, items [75] and [73] "Schenactady" should read --Schenectady--.

Signed and Sealed this

Thirteenth Day of July, 1993

*Attest:*

*Attesting Officer*

Michael K. Kirk

MICHAEL K. KIRK

*Acting Commissioner of Patents and Trademarks*